United States Patent [19]

Sauer

[11] Patent Number: 4,939,350

[45] Date of Patent: Jul. 3, 1990

[54] APPARATUS FOR COUNTING BUNDLED NOTES, ESPECIALLY BANKNOTES

[75] Inventor: Harmut K. Sauer, Himmelstadt, Fed. Rep. of Germany

[73] Assignee: De La Rue Giori S.A., Switzerland

[21] Appl. No.: 253,980

[22] Filed: Oct. 5, 1988

[30] Foreign Application Priority Data

Oct. 9, 1987 [CH] Switzerland ..... 03970/87

[51] Int. Cl.[5] ..... B65H 3/12; G06M 3/02

[52] U.S. Cl. ..... 235/98 C; 235/98 R; 271/94; 271/258; 377/8

[58] Field of Search ..... 235/98 R–98 C; 377/8; 271/94, 103, 109, 258, 95

[56] References Cited

U.S. PATENT DOCUMENTS

| | | | |
|---|---|---|---|
| 3,214,096 | 10/1985 | Buchholz et al. | 235/98 R |
| 3,241,757 | 3/1966 | Uchiyama et al. | 235/98 R |
| 3,795,796 | 3/1974 | Shigemori et al. | 235/98 R X |
| 3,866,828 | 2/1975 | Young | 235/98 R |
| 3,953,022 | 4/1976 | Oshima | 235/98 R X |
| 3,962,564 | 6/1976 | Dutton | 235/98 R X |
| 4,346,289 | 8/1982 | Miyagawa et al. | 235/98 R |
| 4,350,331 | 9/1982 | Middleditch | 235/98 R X |

*Primary Examiner*—Benjamin R. Fuller

*Attorney, Agent, or Firm*—Kane, Dalsimer, Sullivan, Kurucz, Levy, Eisele and Richard

[57] ABSTRACT

The apparatus has separating elements (1) which are fastened at regular intervals to a rotating endless V-belt (21) and which, at the counting station (34), individually separate the note to be counted and temporarily keep it in the counting position. The notes bundled to form a packet rest on edge on a packet holder (35 to 38) which is displaceable transversely relative to the direction of movement of the separating elements (1). The separating elements (1) have a suction face (2) which, during the straight run past the counting station (34), sucks up an upper edge strip of the note to be counted and is made curved in such a way that the edge strip at the same time experiences torsional deformation, thereby being lifted off from the remaining packet. As a result of the spring-back force intrinsic to the notes and counted to torsional deformation, separating errors are reliably prevented in this way. In the sucked-up counting position, the separated note is sensed by an optical counting device and counted and subsequently passes behind the following separating element (1), behind which it engages.

16 Claims, 6 Drawing Sheets

1
2
3
20
20a
20b
21
22
23
27
29
30
30a
31
31a
31,32
32
32a
34
35
36
37
37a
38a
38b
39
39a
39b
40
48
51
60
F1
P
II
III

Fig.9
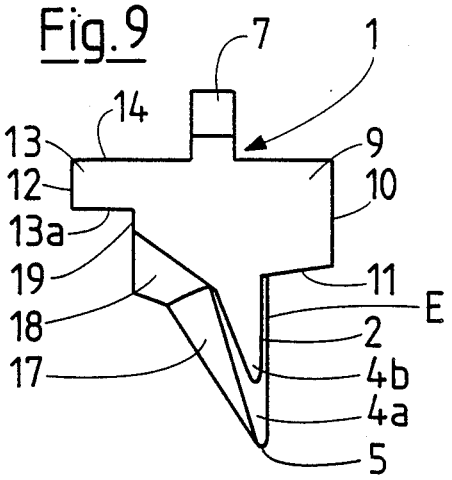
Fig.10
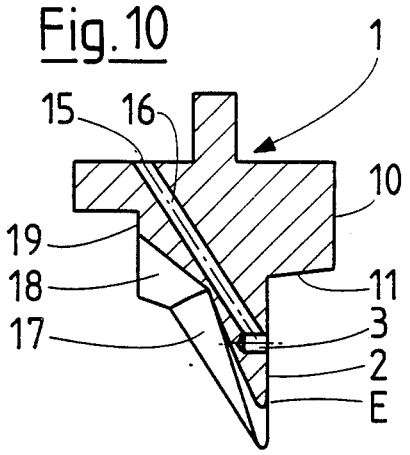
Fig.11
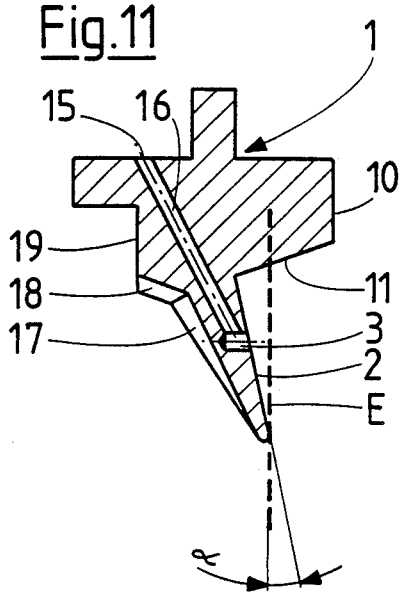
Fig.12
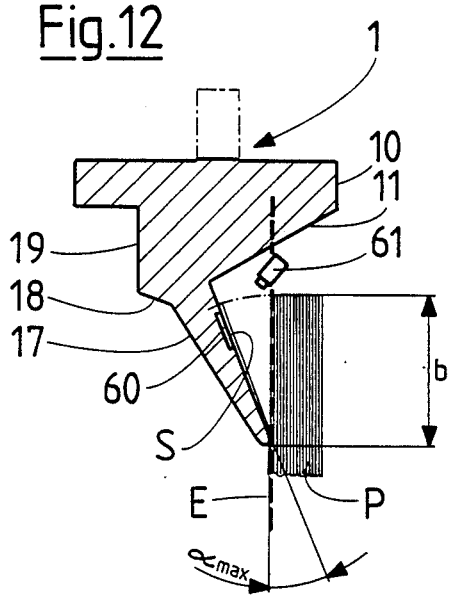
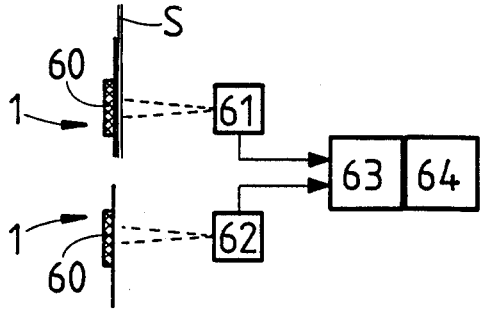
Fig.13

APPARATUS FOR COUNTING BUNDLED NOTES, ESPECIALLY BANKNOTES

BACKGROUND OF THE INVENTION

1. Field of the Invention

The invention relates to an apparatus for counting bundled notes, especially banknotes, according to the pre-characterizing clause of patent claim 1.

2. Description of the Prior Art

Known counting apparatuses of this type, which are use especially as banknote counters, work with a rapidly rotating disc, on the periphery of which the separating elements are arranged. Banknote counters of this type are used, above all, in the further processing of banknotes fresh from printing, which, after they have been numbered and cut to size, are combined to form banded packets, each with, for example, 100 or even 1000 consecutively numbered banknotes. These banknote packets must be checked for completeness before packaging, and because of modern and largely fully automatic processing this counting has to be carried out very quickly. These banknote counters therefore have a very high counting speed which can amount to 200 banknotes per second.

It has been shown, however, that the known banknote counters working with a rotating disc do not operate as reliably as would be desirable. In the most frequent counting error, two banknotes resting on top of one another are sucked up by the suction face of a separating element and are therefore counted as only one note. After the counting of the particular packet has ended, the counting result can therefore imply that one or more banknotes are missing in this packet, and consequently this packet has to be removed from the further processing sequence and counted once again, this usually being done by hand, before it is found that this packet is nevertheless complete. These checks which are required because of defective counting and which are then shown to be unnecessary and frequently result in an interruption of the entire processing rhythm lower the daily work output of the processing installation, necessitate needless manual involvement and are time-consuming. Of the various automatic processing stations used in modern banknote production, counting stations where the bundled banknote packets are checked for completeness have generally hitherto had the relatively highest susceptibility to faults and therefore constitute as it were the bottleneck in the entire modern banknote production process.

The reasons for the relatively low counting accuracy which depends on the paper quality is that, during individual separation, the banknote to be counted is grasped by the suction face in the form of a segment of an arc of a separating element at only one corner of the banknote packet and this corner is bent round to only a very slight extent. The amount by which this corner of a banknote is lifted off from the remaining banknote packet and separated is therefore very small, and this, on the one hand, leads frequently to separating errors and, on the other hand, makes it difficult to detect the individual note reliably during counting, this usually being carried out optically. Separating errors arise because the corner of the note located immediately behind the banknote to be counted is bent round together with this as a result of the suction effect which reaches it too and/or as a result of a certain mutual adhesion of the notes resting on one another.

Also, the production of the hitherto known counting discs with the specially shaped separating elements arranged along their periphery is somewhat complicated and costly, above all when these counting discs are designed as integral castings.

SUMMARY OF THE INVENTION

The object in which the invention is based is to provide a counting apparatus of the type described in the pre-characterizing clause of claim 1, which has a substantially higher counting accuracy and in which separating errors during the individual separation of the notes are virtually eliminated.

According to the invention, this object is achieved by means of the features indicated in the characterizing clause of claim 1.

The result of the rectilinear movement of the separating elements along an entire side edge of a packet, that is to say especially over the entire packet width, is that a substantially longer marginal region of the note to be counted than hitherto is lifted off from the packet, thus at the same time affording the possibility of increasing considerably the separation distance, that is to say the maximum distance which can be obtained during the bending of the note to be counted as a result of a suitable profiling of the suction face. In particular, a sufficiently long separation distance during the bending of the edge strip of the note to be counted ensures that the note located behind it, even when it is initially bent somewhat together with it, comes loose from the foremost note as a result of its inherent elasticity or bending resistance and springs back into its plane initial position, before the edge strip of the note to be counted has experienced its maximum deflection. Thus, not only are separating errors virtually eliminated, but also the reliable detection of the separated note in its counting position is guaranteed.

Furthermore, there is the advantage that the individual separating elements can be manufactured more simply than hitherto and then need only be fastened without difficulty to an endless band, preferably a V-belt. At the same time, the number of separating elements and the length of the band can be varied as desired. This band can rotate without difficulty at a speed of, for example, five meters per second, this corresponding, where notes of banknote format are concerned, to a counting speed of approximately 200 notes per second.

A further advantage of the apparatus according to the invention which increases the efficiency and processing capacity is that, in addition to the straight portion or the straight portions of the endless band, two or more counting stations for the simultaneous counting of several packets by means of the same rotating separating elements can be installed.

Preferably, as seen in the direction of movement, the suction face of the separating elements is limited at the front and at the bottom by straight edges which are at right angles to one another and which lie in a common plane oriented parallel to the face of the note to be counted and, starting from its front edge, is curved away from this plane in such a way that its angle of inclination increases continuously relative to this plane. The rear edge of the suction face which forms the largest angle of inclination with the said plane is preferably likewise straight and at right angles to the lower edge.

This design of the suction face ensures that its front edge and its lower edge, which overlaps the note to be counted along a parallel edge strip, rest against the packet in a straight line and the sucked-up edge strip not only is simply bent round the line defined by the lower edge of the suction face, but also undergoes torsion. Thus, the spring-back force of a note against torsional deformation is utilized in order to avoid a separating error. At the same time, by selecting a somewhat large angle of inclination of the rear edge of the suction face of, for example, 15° to 30°, preferably 20° to 25°, this torsion can be chosen sufficiently high reliably to prevent the following note from participating in this torsional deformation. When the suction face slides along the edge strip of the packet, which can be, for example, 10 to 20 mm, preferably 14 to 18 mm wide, this edge strip of the foremost note is therefore as it were peeled off from the packet, whilst the lower edge of the suction face retains this note on the packet and the rear edge of the suction face keeps the then individually separated note securely in the counting position.

To guarantee that the note lifted off from the packet and counted engages behind the following separating element reliably, the front lower corner of the separating elements which are preferably fastened to the endless band at a distance from one another is rounded in a suitable way.

Expedient embodiments of the counting apparatus according to the invention emerge from the dependent patent claims.

BRIEF DESCRIPTION OF THE DRAWINGS

The invention is explained in detail by means of an exemplary embodiment with reference to the drawings. In these:

FIG. 9 shows a side view of the separating element in the direction of the arrow IX according to FIG. 6, FIGS. 10, 111 and 12 show sections through the separating element according to FIG. 6 along the lines X—X, XI—XI and XII—XII, and FIG. 13 shows a block diagram of the counting circuit.

DESCRIPTION OF PREPARED EMBODIMENTS

Figures 1, 1A:
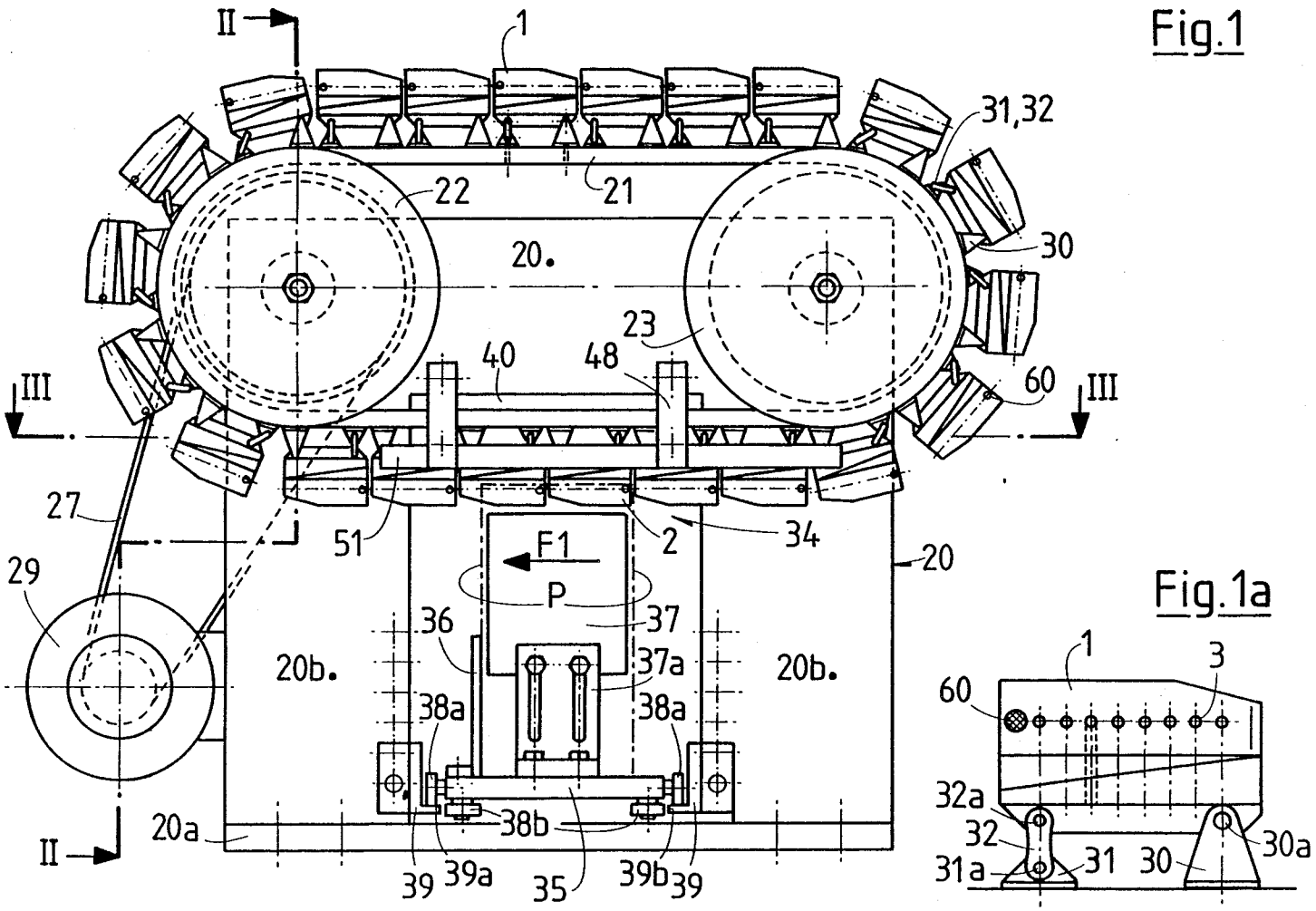
FIG. 1 shows a side view of a preferred embodiment.
FIG. 1*a* shows, on an enlarged scale, a side view of one of the separating elements fastened to the V-belt in an articulated manner.
Figure 2:
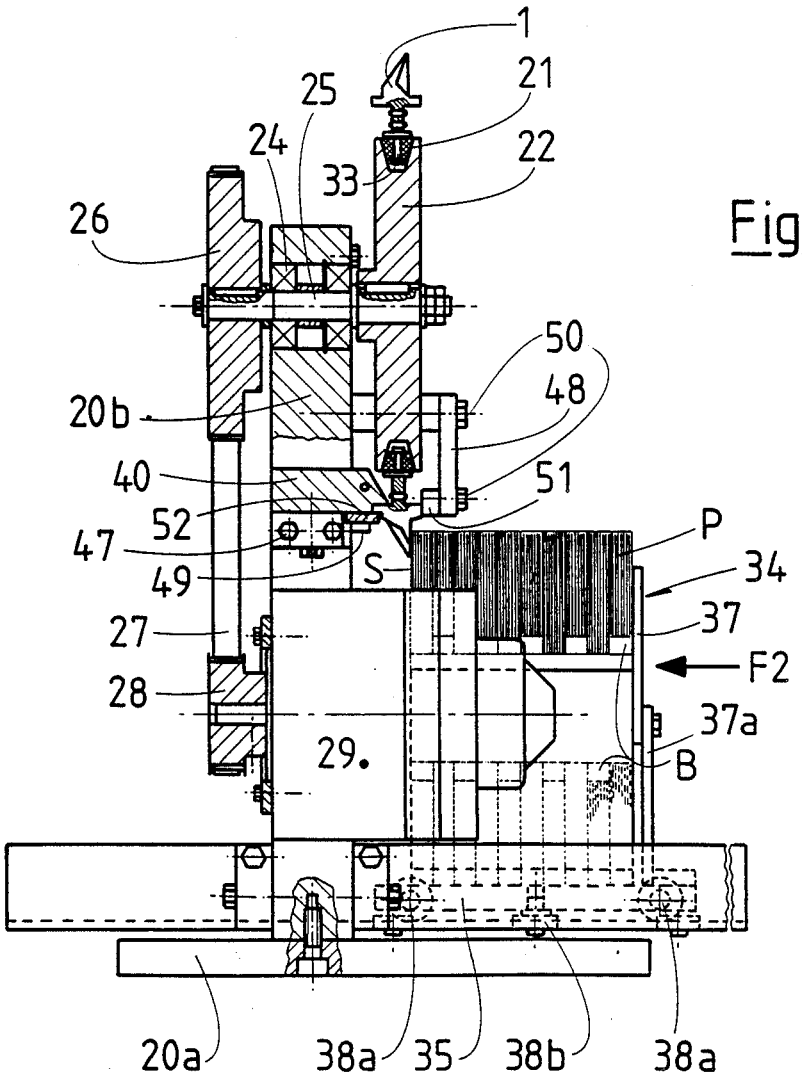
FIG. 2 shows a section along the line II—II according to FIG. 1.

According to FIGS. 1, 1*a* and 2, the apparatus has an endless band installed on a stand 20 and in the form of a V-belt 21 which is guided via the two belt pulleys 22 and 23. These belt pulleys 22, 23 are mounted by means of ball bearings in two pillars 20*b* of the stand 20 which rest on a baseplate 20*a*, FIG. 2 showing the shaft 25 mounted in the ball bearing 24 and belonging to the belt pulley 22. On the side of the pillar 20*b* facing away from the belt pulley 22, the shaft 25 carries a driving-belt pulley 26 driven by means of a belt 27 from an electric motor 29, over the drive wheel 28 of which the belt 27 runs.

The V-belt 21 which, when the apparatus is in operation, rotates in the direction of the arrow F1 according to FIG. 1 carries a plurality of shovel-shaped separating elements 1 which are fastened to the peripheral face of the V-belt in an articulated manner at uniform short distances from one another and the design and function of which are described in detail later. For the articulated fastening of each of the separating elements 1, there are two fastening pieces 30 and 31 (FIG. 1*a*) which are anchored to the V-belt 21 by means of screw bolts 33 (FIG. 2). That end of each separating element 1 at the front in the direction of movement is fastened to the first fastening piece 30 in an articulated manner by means of a pivot pin 30*a*, whilst the rear end is articulated on the second fastening piece 31, with an articulated member 32 interposed, by means of the pivot pins 31*a* and 32*a*.

At the straight portion of the V-belt 21 (the lower according to FIG. 1) extending between the two belt pulleys 22 and 23 is located a counting station 34 with a packet holder which is mounted within the stand 20 so as to be horizontally displaceable transversly relative to the direction of movement of the separating elements 1 and which is composed of a bottom plate 35, of a side wall 36 and of a rear plate 37 of adjustable height. The notes to be counted are bundled to form a packet P which, according to FIG. 2, comprizes ten bundles, each with 100 notes surrounded by a band B, and rest on edge with their lower narrow-side edges on the bottom plate 35. For the purpose of alignment, the vertically oriented packet side on the left according to FIG. 1 rests against the side wall 36 which is fastened to one side of the bottom plate 35, whilst the plate 37 screwed to the rear edge of the bottom plate 35 by means of a fastening part 37*a* supports the rear side of the packet P.

The bottom plate 35 is mounted displaceably by means of rollers 38*a* on horizontal running faces 39*a* and by means of rollers 38*b* on vertical running faces 39*b* of two guide rails 39 which are screwed to the pillars 20*b* so as to be vertically adjustable. In this way, the packet holder together with the packet P can easily be shifted through between the pillars 20*b* during counting.

The function of the separating elements 1 (FIGS. 6 to 12) is, during the run past the counting station 34, to individually separate by suction the note S to be counted and temporarily keep this individually separated note in a specific counting position, in which it is reliably detected by a counting device described further later. In order to suck up the notes, that face of each separating element 1 facing the note to be counted is designed as a suction face 2, the special design of which is explained further later. Each separating element 1 is arranged so that its suction face 2, when passing the counting station, overlaps the upper narrow-side edge of the particular foremost of the notes to be counted, specifically along a region b oriented essentially parallel to this upper edge (FIG. 12). During the time when the suction face slides past, this region b is sucked up by the latter and thereby bent off from the remaining packet in a specific way, as indicated diagrammatically in FIG. 12. The separated note S then temporarily assumes a counting position and is counted by the counting device.

Furthermore, the separating elements 1 are designed so that that edge region of a note which is sucked up by a separating element at the counting station engages behind the following separating element upon the arrival of the latter and the next note is grasped by the suction face of this following separating element. All the counted notes of the packet thereby pass successively onto the other side of the separating elements. A propulsion force exerted on the packet holder in the direction of the arrow F2 in FIG. 2 ensures that, with progressive counting, the entire packet P together with the packet holder is advanced appropriately and is moved through between the two pillars 20*b* of the stand 20. Although the deflecting movement imparted to each counted note which engages behind the respective separating element already generates a certain propulsive force in the direction of this deflection, this effect is nevertheless generally insufficient to advance the packet holder. There are therefore means (not shown) in the form of weights, springs or the like which exert the necessary propulsive force acting on the packet holder.

Figure 6:
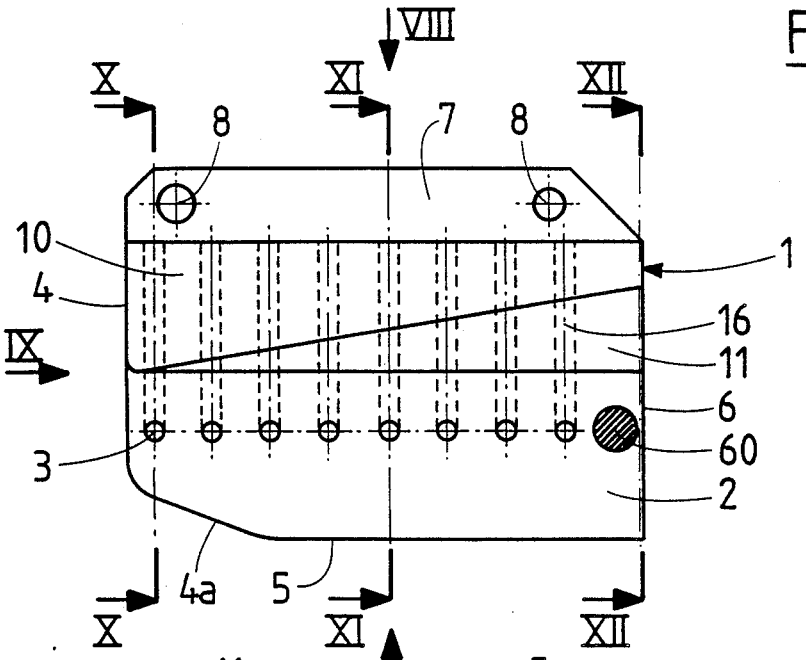
FIG. 6 shows a separating element in an enlarged representation with a plan view of the suction face.
Figure 7:
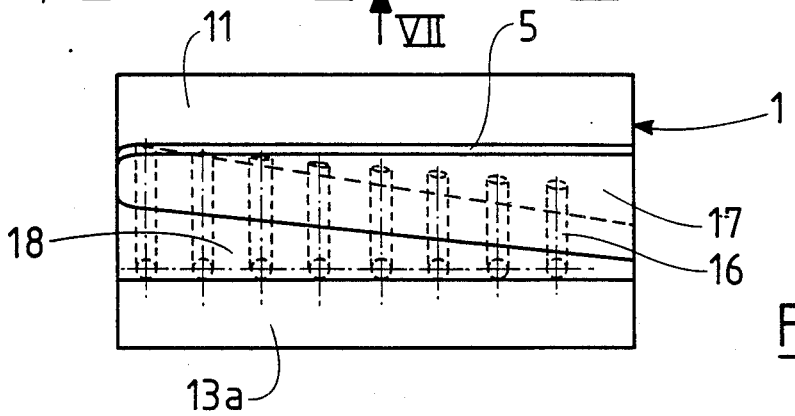
FIG. 7 shows a bottom view of the separating element in the direction of the arrow VII according to FIG. 6.
Figure 8:
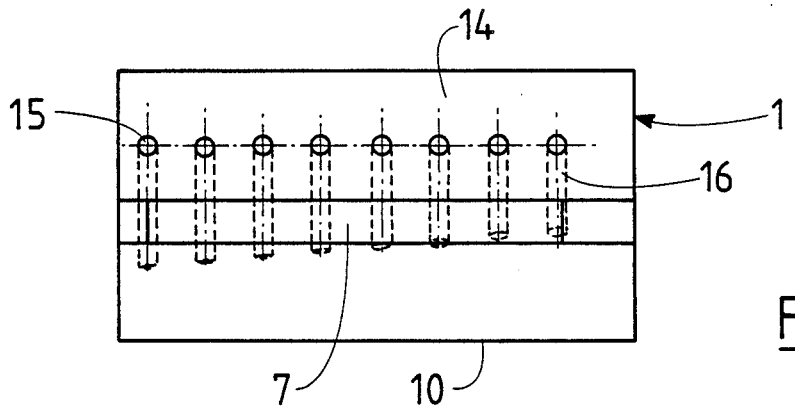
FIG. 8 shows a plan view of the separating element in the direction of the arrow VIII according to FIG. 6.

As shown in FIGS. 6, 10 and 11, in each separating element 1 there are inner suction ducts 16 which open, on the one hand, in the form of suction orifices 3 onto the suction face 2 and, on the other hand, in the form of orifices 15 onto the plane horizontal top side 14 of a flange 13 which projects in the upper region of the separating element 1 on the side facing away from the suction face 2. All the suction orifices 3 and the orifices 15 are arranged at equal intervals in a row extending in the direction of movement of the separating elements 1. In the example under consideration, eight suction orifices 3 are provided.

Figure 3:
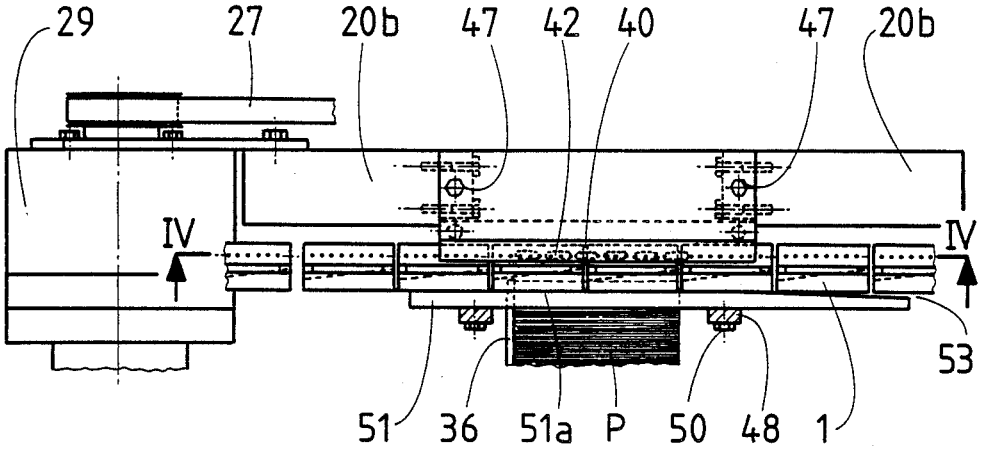
FIG. 3 shows a section along the line III—III according to FIG. 1.
Figure 4:
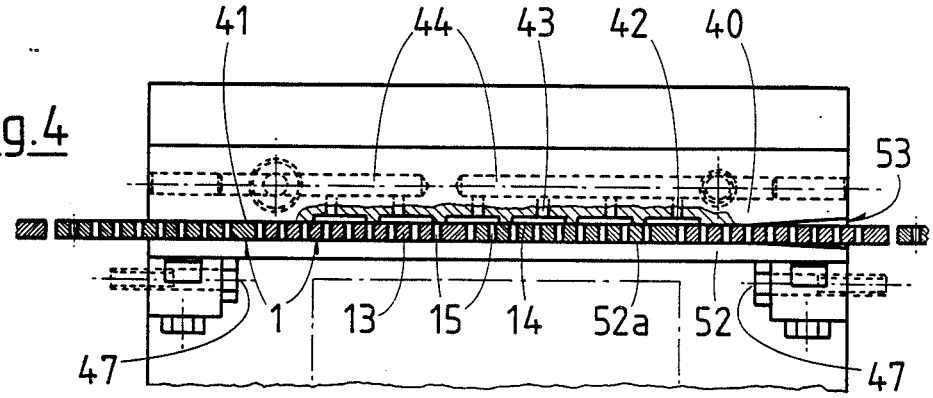
FIG. 4 shows, on an enlarged scale, a section along the line IV—IV according to FIG. 3.
Figure 5:
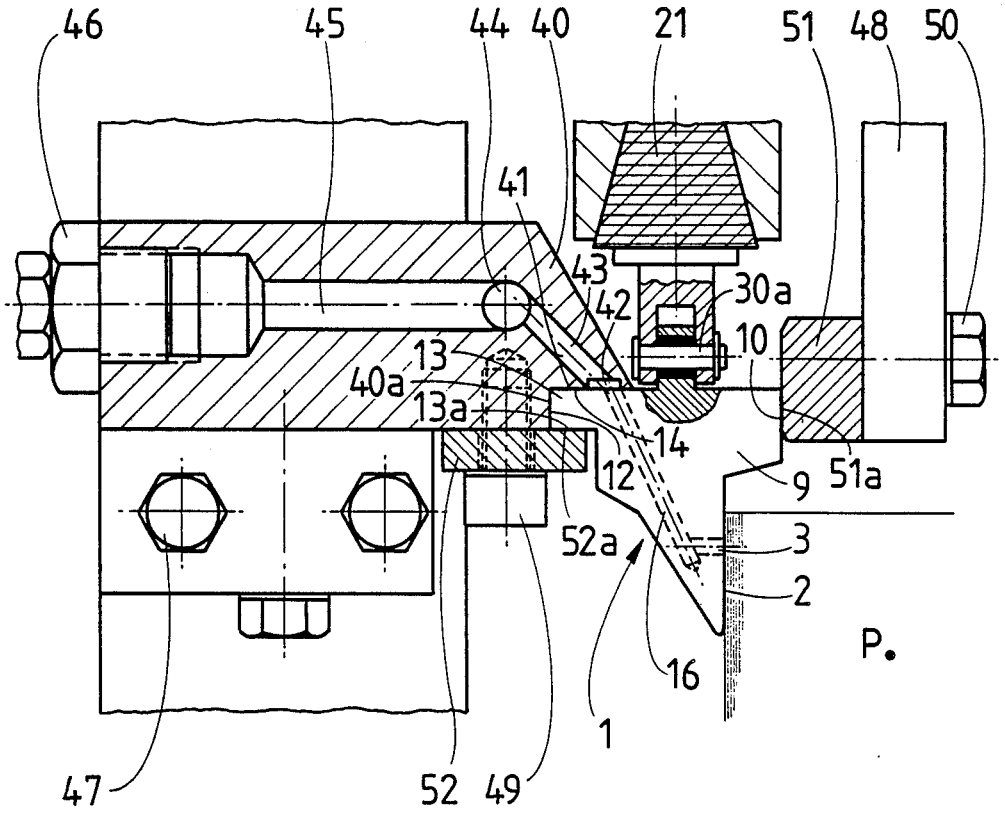
FIG. 5 shows the region of the counting station according to FIG. 2 in an enlarged representation, with the suction-air supply inside the suction strip.

In order to connect the suction orifices 3 of a separating element 1 to a suction-air source during the run past the counting station 34, a suction strip 40 is screwed to the stand 20 along the counting station 34 by means of fastening pieces 47 (FIGS. 3 to 5). This suction strip 40 has a plane horizontal downward-pointing face 41 with long holes 42 arranged in a row which extends in a direction of movement of the separating elements 1 and which, in the example under consideration, is almost twice as long as the row of suction orifices 3 of a separating element 1. These long holes 42 are connected, via suction lines 43, 44 and 45 extending within the suction strip 40, to one or more suction-air inlets 46 which are connectable to an external suction-air source.

During the run of a separating element 1 past the counting station 34, its flange 13 slides along with its top side 14 on the face 41 of the suction strip 40, so that the orifices 15 are successively put in communication with the long holes 42 and a suction effect is therefore generated at the suction orifices 3.

To guarantee that the separating elements 1 always pass the counting station 34 in an exactly defined position and in close-fitting contact with the suction strip 40, on the stand 20 there are two guide rails 51 and 52 (FIGS. 2 to 5) which extend in the direction of movement of the separating elements 1 and which guide these. The separating elements 1 have two vertically oriented guide faces which are formed, on the one hand, by the end face 12 of the said flange 13 and, on the other hand, by the end face 10 of an opposite flange 9 (FIG. 9) formed on above the suction face 2 so as to project laterally. The underside 13*a* of the flange 13 forms a further guide face.

The guide rail 51 has a vertically oriented leading face 51*a* and is attached to the stand 20 by means of fastening parts 48 and screws 50 in such a way that the end face 10 of the separating elements 1 is guided by this leading face 51*a* and the opposite end face 12 is guided by a leading face 40*a* provided on the suction strip 40.

The other guide rail 52 has a horizontally oriented leading face 52*a* for guiding the under side 13*a* of the flange 13 and is fastened to the suction strip 40 by means of screws 49 in such a way that the top side 14, having the orifice 15, of the flange 13 is kept in contact with that face 41 of the suction strip 40 having the long holes 42.

To make it easier for a separating element 1 to run into the slot formed between the suction strip 40 and the guide rail 52, this slot is widened somewhat at the run-in point 53 (FIG. 4) as a result of a slight bevelling of the faces limiting it. Likewise, the leading face 51*a* of the guide rail 51 (FIG. 3) is bevelled somewhat at the run-in end 53.

FIGS. 6 to 12 illustrate in detail the design of a separating element. On the side which, in the assembled state, faces the notes to be counted, the separating element 1 has the already mentioned suction face 2 with the suction orifices 3. This suction face 2 is limited by a front edge 4 as seen in the direction of movement, by a lower edge 5 overlapping the notes to be counted and extending parallel to its top edge, and by a rear edge 6 (FIG. 6). The front lower corner 4*a* is rounded or bevelled. The front edge 4 and the lower edge 5 are at right angles to one another, lie in a common plane E oriented parallel to the face of the notes in the packet P and, during the run past the counting station, are therefore laid in a straight line against the note S to be counted which is thus retained along the lower edge 5 against the packet located behind it. The suction face 2 is curved in such a way that, starting from its front edge 4, its angle of inclination $\alpha$ relative to the said plane E passing through the front edge 4 and the lower edge 5 increases continuously in the direction of the rear edge 6 (FIGS. 10 to 12). This rear edge 6 is likewise made straight and is oriented perpendicularly relative to the lower edge 5; it defines the maximum angle of inclination $\alpha$ max of the suction face 2 at its rear end (FIG. 12).

The separating element 1, on its top side, has an upward-pointing fastening flange 7 with two orifices 8 for the passage of the pivot pins 30*a* and 31*a* respectively. This fastening flange 7 is bevelled at the front and rear ends.

Formed on underneath the fastening flange 7 is the flange 9 which projects beyond the suction face at the top and which, in the assembled state of the separating element 1, engages over the packet P somewhat at the counting station and the end face 10 of which is guided by the guide rail 51. The underside 11 of this flange 9 forms with the said plane E an angle which, in the example under consideration, is only a little larger than 90° at the front edge 4 of the suction face and which increases continuously in the direction of the rear edge 6, the angle between the suction face and the underside 11 remaining virtually the same over the length of the suction face. The inner edge between the suction face 2 and the underside 11 is straight and parallel to the lower edge 5. The height of the end face 10 therefore decreases continuously in the direction of the rear edge 6 of the suction face.

On the side facing away from the flange 9, on the separating element 1 there is, underneath the fastening flange 7, the rectangular flange 13, the plane top side 14 of which slides along on the suction strip 40 and has the said orifices 15 which are in communication with one of the suction orifices 3 via a respective suction duct 16 provided in the body of the separating element 1. As mentioned, the plane under side 13*a* of the flange 13 is guided by the guide rail 52 during the run past a counting station.

That side of the separating element 1 facing away from the suction face 2 has a sliding face 17 for the counted notes engaging behind the separating elements. This sliding face 17 has relative to the plane E an inclination increasing continuously from the front end of the separating element to the rear end and, at the transition to the front rounded corner 4*a*, is convexly curved in such a way that the front end 4*b* of approximately triangular cross-section (FIG. 9) tapers forwards. In this way, the note just counted, which still rests against the suction face 2 of the preceding separating element, can engage behind this tapered front end 4*b*, whilst at the same time the suction face 2 sucks up the following note.

Above the sliding face 17 there is a projecting step which is limited by an underside 18 and laterally by a plane end face 19. This end face 19 has the flange 13 projecting beyond it and is oriented at right angles to the underside of the latter. In the example under consideration, the angle formed by the underside 18 with the end face 19 decreases from the front end of the separating element to the rear end. The inclination of the underside 18 therefore runs in the opposite direction to the inclination of the underside 11 of the flange 10, once again the angle between the sliding face 17 and the underside 18 remaining virtually the same and the inner edge between the sliding face 17 and the under side 18 being straight and parallel to the lower edge 5 of the suction face 2. The height of the end face 19, as measured from the flange 13, is therefore less at the front end of the separating element 1 than at the rear end.

The example under consideration relates to a separating element 1 produced by mechanical machining. The specially curved design of the undersides 11 and 18 and their angles of inclination relative to the suction face 2 and to the sliding face 17 are therefore governed by the production conditions and are determined by the shape of the milling cutter used.

The separating elements 1 can also be castings, for example from chromium-plated aluminum or from plastic. If they are cast, the undersides 11 and 18 can also be shaped differently, and only the flange 9 has to be formed so that that region of the separated note S to be sensed is detected perfectly for the purpose of counting by the optical counting device explained later.

The result of the special design of the curved suction face 2 is that the sucked-up edge strip of a note is not only bent round the lower edge 5 of the suction face, but at the same time twisted about an imaginary straight line lying parallel to this lower edge 5. Since the spring-back force of paper, especially banknote paper, during torsional deformation is usually greater than during pure bending deformation, this guarantees that an adjacent note which is possibly taken up by the just sucked-up note to be counted and which possibly adheres somewhat to the rear side of the sucked-up note or is also subjected to the suction effect resumes its plane initial form reliably before the note to be counted has reached its maximum torsional deformation. In particular, the note taken up cannot follow this deformation because of its inherent elasticity.

Because of the rectilinear movement of the separating elements which lift off from the packet an essentially parallel edge strip of the note to be counted, the maximum torsional deformation can be selected sufficiently high reliably to prevent separating errors which have hitherto impaired the perfect functioning of known banknote counters. Thus, the maximum angle of inclination $\alpha$ max of the suction face 2 at its rear edge 6 can be between 15° and 30°, preferably between 20° and 25°; in the example under consideration, this maximum angle of inclination $\alpha$ max is approximately 23°. The height b over which the suction face 2 overlaps the upper side edge (FIG. 2) can amount, for example, to between 10 and 20 mm, preferably between 14 and 18 mm; in the example under consideration, it is approximately 16 mm. With the dimensions indicated in the example under consideration, the sucked-up upper edge strip of a note is lifted off from the remaining packet a maximum of approximately 20 mm, at the same time experiencing torsional deformation.

If appropriate, the suction power prevailing at the suction orifices during the individual separation of a note can be of differing amount and can increase from the front edge of the suction face 2 to the rear edge.

This relatively high deformation which the sucked-up edge strip of a note experiences in its counting position also makes it easier for the separated note to be sensed reliably by the counting device which, in the example under consideration, is an optical counting device working with laser light. A round reflecting zone 60 is therefore formed on the suction face 2 of each separating element 3 and is located approximately at the height of the row of the suction orifices 3 and behind these, as seen in the direction of movement, where the note to be counted is lifted off most from the remaining packet. The counting device, the circuit of which is shown in the block diagram according to FIG. 13, has a first reflex tracer 61 which, at the counting station 34, is pointed to the reflecting region 60 of the passing separating elements 1, and a second reflex tracer 62 which is mounted next to the counting station and which is aligned so that it likewise senses the reflecting zones 60 of the separating elements 1 moved past. When a note has been separated correctly and assumes its counting position resting against the suction face 2, then during sensing by the first reflex tracer 61 the reflecting zone 60 is, of course, covered by this note S, so that the laser beam cannot be reflected on this zone 60. In this case, the two reflex tracers 61 and 62 give different measurement results, since, of course, at the same time the second reflex tracer 62 indicates a reflected reflex, and a counter 64 connected to the two reflex tracers via an electronic circuit 63 is shifted one number onwards. This comparitive measurement with two reflex tracers prevents possible faults as a result of changing external light conditions and also the dependence of the measuring accuracy on a specific intensity threshold to be set for the sensed reflected light. Moreover, in order to check the counting, a vacuum detector can also be provided, so that the abruptly increased vacuum in the suction-air system occurring each time when a note rests against the suction face is measured.

A further essential advantage of the counting apparatus according to the invention is that two or more counting stations of the same design, each with a packet holder and a counting device, can be provided at the straight portion or at the straight portions of the rotating V-belt, so that several packets are counted simultaneously.

The invention is not restricted to the exemplary embodiment illustrated and especially not to the above-described special design of the separating element with its suction face and to the above-described counting device, but also includes other designs, above all with regard to the shaping of the suction face and consequently the deformation of the sucked-up edge strip of a note. However, it has been shown that it is especially advantageous if the suction face is curved so that the sucked-up edge strip is subjected to torsional bending. The exact dimensions of the suction face are appropriately selected as a function of the paper quality.

Also, in principle, the separating elements 1 can be fastened to the V-belt in such a way that they overlap one another somewhat. However, for a perfect optical detection of the notes to be counted it is more expedient to mount the separating elements at a certain distance from one another.

I claim:

1. An apparatus for counting bundled notes having narrow side edges, including a displaceably mounted packet holder for supporting a packet (P) of said notes and a device for separating individually the notes to be counted (S), comprising a plurality of shovel-shaped separating elements (1) which are arranged successively in a direction of movement on a carrier (21) moved continuously past a counting station (34) and which, on a side facing the notes to be counted (S), each of said separating elements having a suction face (2), said suction face provided with open suction orifices (3) connectable to a suction-air source, a marginal region of each of said notes to be counted is laid against said suction face as a result of a suction effect, is simultaneously lifted off from the packet (P), and thereby temporarily assumes a counting position, said region of said notes resting against the suction face of each of said separating elements when the following separating element arrives, engages behind a following separating element on arrival of said following separating element and all counted notes of the packet pass successively onto a side opposite the suction face of the separating elements forming a sliding face (7), and a counting device (60, 61, 62) for counting particular individually separated notes associated with said counting station wherein the carrier of the separating elements (1) is a rotating endless band (21), with at least one straight portion, wherein the counting station (34) is installed at said straight portion, and wherein the suction face (2) of the separating elements (1) overlaps an edge strip oriented essentially parallel to side narrow side edges of the notes.

2. An apparatus as claimed in claim 1, wherein a front edge (4) of the suction face (2) in the direction of movement of said separating element and a lower edge (5) of the suction face (2) overlapping the note lie in a common plane (e) oriented parallel to the notes, wherein the suction face (2), starting from the front edge (4), is curved away from the common plane (E) in such a way that an angle of inclination (a) increases continuously relative to said plane (E), and wherein a front lower corner (4*a*) of the separating elements (1) is rounded.

3. An apparatus as claimed in claim 2, wherein the front edge (4) and the lower edge (5) of the suction face (2) are straight and preferably at right angles to one another, and wherein a rear edge (6) of the suction face (2) forming a largest angle of inclination ($\alpha$ max) with the said plane (E) is likewise straight and preferably at right angles to the lower edge (5).

4. An apparatus as claimed in claim 3, wherein, for notes with a banknote format, the maximum angle of inclination ($\alpha$ max) of the suction face (2) relative to the said plane (E) is between 15° and 30°, preferably between 20° and 25°, and wherein the suction face (2) overlaps the side edge of the note to be counted (S) 10 to 20 mm.

5. An apparatus as claimed in one of claim 1, wherein the suction face (2) of each separating element (1) has a plurality of suction orifices (2), arranged in a row.

6. An apparatus as claimed in claim 5, wherein a suction power prevailing at the suction orifices (3) of the suction face (2) during individual separation can be set at a differing amount and increases from the front edge (4) to a rear edge (6) of the suction face (2).

7. An apparatus as claimed in claim 1, wherein the separating elements (1) have a plane side (14) which is oriented parallel to the direction of movement and onto which open suction ducts (16) leading to the suction orifices (3) on the suction face (2), and which, at the counting station (34), slides on a plane face (41) of a fixedly installed suction strip (40) connected to the suction-air source.

8. An apparatus as claimed in one of claim 1, wherein the separating elements (1), in an upper region fastened to the endless band (21) have guide faces (10, 12, 13*a*) which are oriented parallel to the direction of movement and which, during a run past the counting station (34), are guided by leading faces (51*a*, 52*a*, 40*a*).

9. An apparatus as claimed in claim 7 or 8, wherein the separating elements (1) have flanges (9, 13) projecting laterally above the suction face (2) and the sliding face (17), and end faces (10, 12) of the two flanges (9, 13) are two of the said guide faces, wherein an underside or a topside of one flange (13) has a third guide face (13*a*) and a second flange side, located opposite the third guide face, of said flange (13) forms a plane face, onto which the suction ducts (16) open.

10. An apparatus as claimed in claim 1, wherein the separating elements (1) are fastened to the endless band (21) at a distance from one another.

11. An apparatus as claimed in claim 1, wherein several counting stations, each with a packet holder and a counting device, are arranged on the straight portion of the endless band (21).

12. An apparatus as claimed in claim 1 wherein the counting device (60, 61, 62) is a device working optically, having two reflex tracers (61, 62), an electronic circuit (63) connected to said two reflex tracers, and a counter (64) connected to said two reflex tracers, and a counter (64) controlled by the electronic circuit, and wherein the suction face (2) of each of said separating elements (1) has at least one reflecting zone (60), one of said two reflex tracer (61) sensing a particular separating element (1) which passes the counting station (34) and the reflecting zone (60) of said separating elements (1), and the electronic circuit (63) shifting the counter (64) a count position whenever a measurement result obtained from the two reflex tracers are different.

13. An apparatus as claimed in claim 1, wherein the counting device has a vacuum detector which measures an increased vacuum in the suction-air system which is caused when a note is laid against the suction face (2).

14. An apparatus as claimed in claim 1, wherein means are provided for generating a propulsion force acting on the packet holder (35 to 37).

15. An apparatus according to claim 14 wherein said generating means include weights.

16. An apparatus according to claim 14 wherein said generating means include springs.

* * * * *